US007204471B2

(12) United States Patent
Pietrobon

(10) Patent No.: US 7,204,471 B2
(45) Date of Patent: Apr. 17, 2007

(54) METHOD AND ARRANGEMENT FOR FORMING CONSTRUCTION PANELS AND STRUCTURES

(75) Inventor: Dino Lino Pietrobon, Athelstone (AU)

(73) Assignee: Tiltform Technologies Ltd., North Adelaide (AU)

( * ) Notice: Subject to any disclaimer, the term of this patent is extended or adjusted under 35 U.S.C. 154(b) by 415 days.

(21) Appl. No.: 10/311,763

(22) PCT Filed: Jun. 15, 2001

(86) PCT No.: PCT/AU01/00712

§ 371 (c)(1),
(2), (4) Date: Dec. 16, 2002

(87) PCT Pub. No.: WO01/96690

PCT Pub. Date: Dec. 20, 2001

(65) Prior Publication Data

US 2003/0155683 A1 Aug. 21, 2003

(30) Foreign Application Priority Data

Jun. 16, 2000 (AU) ..... PQ8220

(51) Int. Cl.

| | |
|---|---|
| ***B28B 7/02*** | (2006.01) |
| ***E04G 17/14*** | (2006.01) |
| ***E04G 11/36*** | (2006.01) |
| ***E04F 11/48*** | (2006.01) |
| *B29C 39/00* | (2006.01) |

(52) U.S. Cl. ..... 249/139; 249/155; 264/133; 264/130; 264/275

(58) Field of Classification Search ..... 264/274, 264/275, 279, 279.1, 130, 133; 249/96, 97, 249/139, 155, 159, 91
See application file for complete search history.

(56) References Cited

U.S. PATENT DOCUMENTS

| | | | | |
|---|---|---|---|---|
| 1,657,566 | A * | 1/1928 | Crozier | 264/130 |
| 2,531,990 | A * | 11/1950 | Rappoli | 264/219 |
| 2,871,619 | A * | 2/1959 | Walters | 446/110 |
| 3,181,276 | A * | 5/1965 | Ballou | 52/701 |

(Continued)

FOREIGN PATENT DOCUMENTS

WO WO 98/49415 A1 * 11/1998

OTHER PUBLICATIONS

Frederick C. Mish, Webester's Ninth New Collegiate Dictionary, 1985, Merriam-Webster, Inc., p. 174.*

*Primary Examiner*—Christina Johnson
*Assistant Examiner*—Patrick Butler
(74) *Attorney, Agent, or Firm*—Priest & Goldstein, PLLC

(57) ABSTRACT

A form-work support arrangement for building form-work for moulding a concrete construction panel on top of a previously poured concrete panel (58). Generally the upper panel to be moulded has the same horizontal dimensions as the previously poured panel (58), the arrangement including an anchor bracket (60) adapted to be removably attached (66) to the previously poured concrete panel (58), an edge form bracket (48) adapted to be removably attached (16) to the anchor bracket (60), the edge from bracket (48) adapted to removably support an edge form (18) having an outer face, the outer face defining an edge of the concrete panel to be poured and positioned so that the outer face is generally above the edge of the previously poured concrete panel (58).

9 Claims, 12 Drawing Sheets

U.S. PATENT DOCUMENTS 3,182,948 A * 5/1965 Lawrence ..... 249/18
3,236,019 A * 2/1966 Ballou ..... 52/705
3,495,800 A * 2/1970 Fisher ..... 249/20
3,609,935 A * 10/1971 Thomas ..... 52/745.11
3,618,181 A * 11/1971 Veale ..... 425/188
4,141,532 A * 2/1979 Wall ..... 249/94
4,506,428 A * 3/1985 Gerhard ..... 29/446
5,616,271 A * 4/1997 Podgurski ..... 249/48
5,766,645 A * 6/1998 Kaminski ..... 425/63
5,975,147 A * 11/1999 King et al. ..... 139/91
6,540,201 B1 * 4/2003 Gagnon et al. ..... 249/139

* cited by examiner

METHOD AND ARRANGEMENT FOR FORMING CONSTRUCTION PANELS AND STRUCTURES

BACKGROUND OF THE INVENTION

The present invention relates to form-work. In particular, the present invention is applicable to form-work manufactured from concrete and other curable non-solid material. It is however to be understood that the invention is not intended to be limited to concrete construction only and that this is intended for explanatory purposes only.

In the building and construction industry it is a well accepted method to construct a structure by use of form-work that is manufactured in situ by pouring concrete into pre-defined form-work. This type of method enables the construction of various structures including but not limited to walls, slabs and kerbs but to mention a few.

Typically the walls of a building are made from relatively large concrete panels that are manufactured in-situ. This is advantageous for it eliminates the complexity and expense of manufacturing these panels off-site and transporting them to the construction site. Furthermore, in-situ construction places fewer restrictions on the size and shape of the panels than would normally be the case where the panels have to be transported.

One method of manufacturing concrete panels is to use suitable material such as timber or plywood to define an enclosed area or cavity into which concrete is poured. Once set, the poured concrete panel is then used as a base for the next panel. Obviously during this process it is necessary to construct new form-work for each new panel or wall and typically a number of panels are made in a stack arrangement, sometimes even more than six panels high, with each panel poured and cured in sequence. To prevent each panel adhering to the other, once cured, the surface of the immediately cured panel is coated with a suitable substance that prevents adhesion of the panels to each other. One such substance is commonly known as bond breaker. The process is repeated until a stack of panels are finished the panels being subsequently lifted and erected as desired.

It is also known to construct a frame which accommodates a number of panels that are stacked vertically, there being separate risers responsible for the form-work of a separate concrete panel. This type of construction is complex and at times difficult and does not enable for different size panels to be made. One way of overcoming this problem is to use sliding risers, but once again, this requires framework to support the various sliding risers. It is an object of the present invention to overcome at least some of the above-mentioned problems or provide the public with a useful alternative.

SUMMARY OF THE INVENTION

In one aspect of the invention there is proposed a form-work support arrangement for building form-work used for moulding a concrete construction panel on top a previously poured concrete panel wherein the upper panel to be moulded has the same horizontal dimension as the previously poured panel said arrangement including:

an anchor bracket adapted to be removably attached to said previously poured concrete panel;

an edge form bracket adapted to be removably attached to the anchor bracket;

said edge form bracket adapted to removably support an edge form having an outer face said outer face defining an edge of the concrete panel to be poured and positioned so that the outer face is generally above the edge of the previously poured concrete panel.

Preferably said edge form supports externally accessible ferrules within the form-work arrangement prior to the concrete being poured the ferrules then being embedded within the concrete panel.

Advantageously said anchor bracket is attached to the concrete panel by the use threaded bolts engaging said anchor bracket and said ferrules.

Advantageously said anchor bracket is a right angled bracket having a base and a side, said base adapted to support said edge form.

Preferably said edge form bracket is a right angled bracket having a base and a side, said base adapted to engage said anchor bracket.

In preference said anchor bracket has a tilting means to adjust the vertical orientation of said anchor bracket.

Preferably the adjustable means includes a threaded bolt engaging said anchor bracket wherein upon rotation of the bolt in one direction it is caused to abut against the side of the concrete panel and move the anchor plate away form said panel and upon rotation in the other direction it is caused to move the anchor plate in a direction towards said panel.

In preference said anchor bracket has a tilting means to adjust the vertical orientation of said anchor bracket.

Preferably the adjustable means includes a threaded bolt engaging said anchor bracket wherein upon rotation of the bolt in one direction it is caused to abut against the side of the concrete panel and move the anchor plate away form said panel and upon rotation in the other direction it is caused to move the anchor plate in a direction towards said panel.

In preference said edge form bracket base includes a slot extending substantially along its length, said slot adapted to accommodate a fixing means attaching said edge form bracket to said anchor form bracket.

In another aspect of the present invention there is proposed a form-work support arrangement for building form-work used for moulding a concrete construction panel on top a previously poured concrete panel wherein the upper panel to be moulded has the same or smaller horizontal dimension as the previously poured panel said arrangement including:

a bottom bracket adapted to be removably attached to said previously poured concrete panel located on a base;

a top bracket adapted to be removably attached to the bottom bracket;

said bottom bracket adapted to be attached to the previously poured panel by the use of fixing means;

said top bracket removably attached to the bottom bracket by the use of at least one fixing means passing through said top bracket and engaging an anchor means in the bottom bracket;

said top bracket adapted to removably support a sideform having an outer face said sideform defining the outer face of the concrete panel to be poured.

In a yet further aspect of the present invention there is proposed a form-work support arrangement for mounting on at least one concrete panel including:

at least one edge-form bracket for securably supporting an edge-form at a form-work location;

a slidable strut member securably attached to said edge-form bracket;

an anchor bracket adapted to be secured to said side of said concrete panel, and supporting said slidable strut member for transverse movement across said anchor bracket; and a locking means for locking the slidable strut member in a fixed position to said anchor bracket whereby said edge-form can be moved across said concrete panel to thereby define a new form-work location.

In a still further form of the invention there is proposed a method A method of constructing concrete panels including the steps; of (a) preparing a casting bed, (b) securing edge forms to edge form brackets that are secured to the casting bed to define a void and with ferrules extending into said void, (c) pouring concrete into the void volume defined by the form-work and letting it cure to form a concrete panel, (d) coating said upper surface of the cured concrete panel with a bond breaker. (e) removing the edge form brackets supporting the edge forms from the casting bed, (f) securing anchor brackets to the first concrete panel using the cast ferrules, (g) attaching the edge form brackets supporting the edge forms to the anchor brackets to thereby define a second volume to be filled with concrete to define a second concrete panel.

BRIEF DESCRIPTION OF THE DRAWINGS

To assist in understanding the invention a preferred embodiment will now be described, by way of example only, with reference to the following figures.

It is to be understood that throughout the figures and description the same reference number is used to refer to the same feature. It is also to be understood that the figures are to be used for illustrative purposes only and are not intended to be limiting.

DETAILED DESCRIPTION OF THE PREFERRED EMBODIMENT

The concrete panel manufacturing arrangement includes a number of individual components or parts that are used together to provide for and define form-work into which concrete is poured to thereby make a concrete panel.

To manufacture concrete panels in-situ one first prepares the site by making a casting bed 10 at the construction site. Those skilled in the art will appreciate that this is accomplished by first suitably preparing a ground surface to be able to support the weight of a stack of panels. On top of this is then laid the casting bed. Generally, the casting bed 10 is manufactured from concrete. It is prepared and finished as with most concrete floors so as to provide a smooth and level surface. The casting bed is then ready to be used in the panel manufacturing process.

Figure 1:
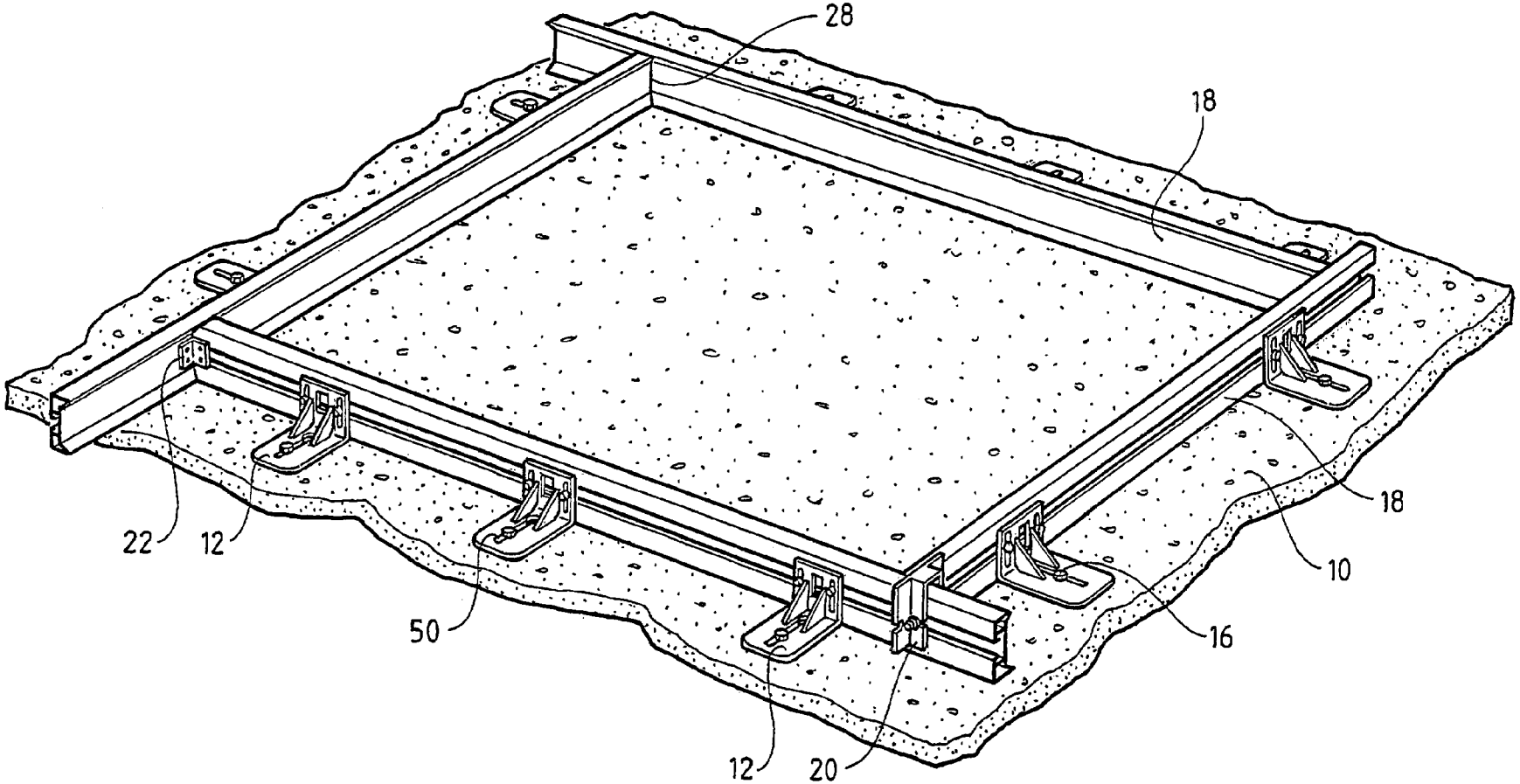
FIG. 1 is a perspective view of a concrete panel manufacturing arrangement according to the present invention and illustrating the use of edge form brackets.
Figure 2:
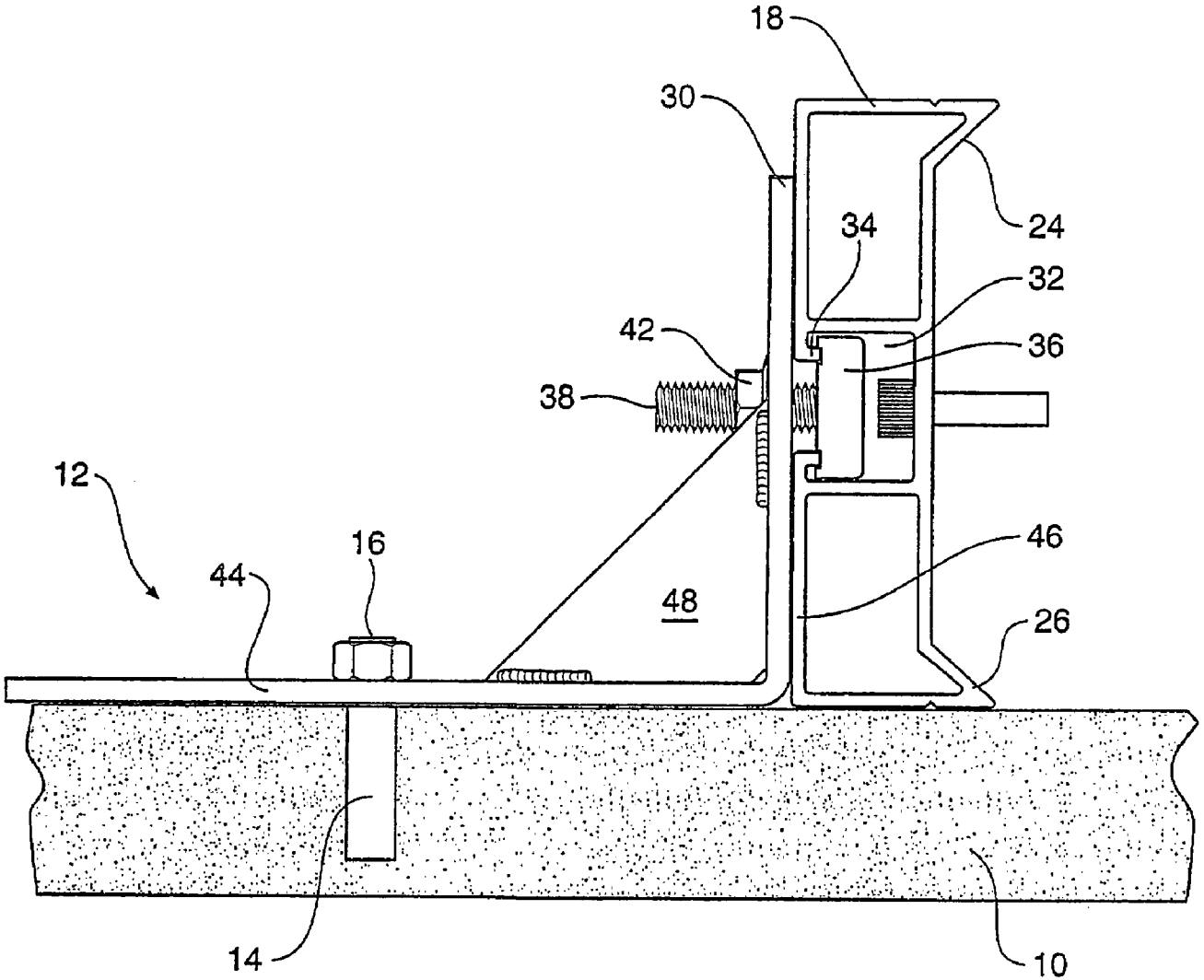
FIG. 2 is a cross-sectional view of one edge form bracket supporting an edge form attached to the casting bed arrangement of FIG. 1.
Figure 3:
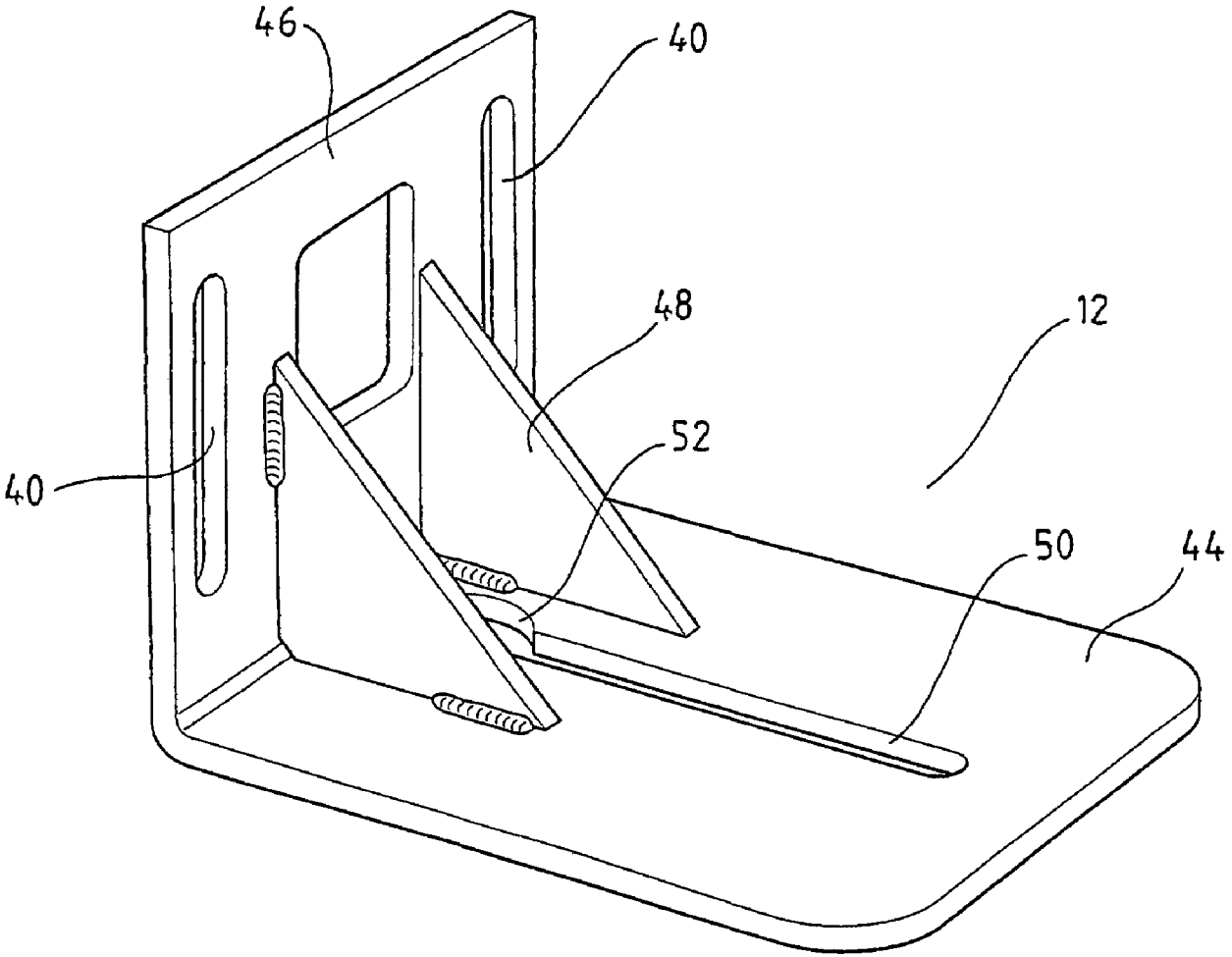
FIG. 3 is a perspective view of the edge form bracket.

Illustrated in FIG. 1 is a typical arrangement prepared for the manufacture of a first panel on a casting bed whilst detailed in FIGS. 2 and 3 are the elements that are used.

Edge form or side form brackets 12 are fixed to anchor holes 14 in the casting bed 10. They are fixed by the use of appropriate fixing means such as threaded screws 16. The anchor holes 14 may be provided by drilling into the casting bed when cured or by casting them into the bed when the concrete was first poured.

The edge form brackets 12 are used to support edge forms 18 (sometimes referred to as side forms) which may come in a variety of lengths and widths and which are joined to each other at their corners by edge form corner connectors 20 or by the use of a small angle bracket 22. The use of these corner connectors allows edge forms that are too long to still be used in forming the form-work without requiring to be trimmed as is the case with using standard timber board construction.

As more clearly illustrated in FIGS. 2 and 3 the edge form 18 is of a generally rectangular construction including triangular fillets at the front surface of the edge form, there being a fillet 24 at the bottom and fillet 26 at the top edge of the front face of the edge form. The fillets could be integral with or separately attached to the edge form 18.

The ends of the edge form are generally perpendicular to the length of the edge form so that the end of the edge form can neatly abut the adjoining edge form as shown at location 28.

Located at the rear surface 30 of the edge form 18 is a channel 32 having inwardly folded flanges 34. The edge form bracket 12 is then attached to the edge form by the use of at least one rectangular locking block 36 whose dimensions are such that its width is less than the width of the channel entrance or aperture between the flanges and that can thus be inserted into the channel (in a sideways orientation) but whose height is greater than the width of the channel between the flanges. Once inserted into the channel the block 36 is then rotated by 90 degrees whereupon it is then captured and held within the channel. A threaded bolt 38 is fixed to the block 36 and of sufficient length to pass through aperture 40 in the edge form bracket. A suitably internally threaded nut 42 is used to engage the bolt 38 and is of a size that its diameter is greater than the width of the aperture 40. One can hence appreciate that upon appropriate rotation of the nut, generally in the clockwise direction, by the use of a wrench or other suitable tool draws the edge form bracket and the edge form together. Obviously, one can simply unscrew the nut by rotating it in the opposite, that is anti-clockwise direction to release the edge form 18 from the edge form bracket 12.

As illustrated in FIG. 3, the edge form bracket is typically an L-shaped or right-angled bracket having a base 44 and a side 46. Bracing elements 48 provide the additional strength to maintain the bracket shape even when the side 46 experiences a load. Typically it will be appreciated that as illustrated each edge bracket is attached to an edge form by the use of two locking blocks 36. Further, the aperture 40 is in fact a slit that allows for the relative movement of the edge form with respect to the bracket. As will be appreciated by those skilled in the art that feature allows the edge form to be raised and lowered with respect to the bracket.

It is to be understood that other typical of attachment means between the edge form and the edge form bracket may be used and it is not intended to limit the invention to the particular arrangement described. What is important is that the edge form and the edge form bracket can be fixedly attached together when in the correct relative position. The present system enables the edge form bracket to engage the edge form at different position by the use of the channel.

As discussed previously the edge form bracket may be fixed to the casting bed by the use of a threaded screw 16 engaging anchor 14 in the casting bed. This threaded screw may be rotatably fixed to the bracket or alternatively may pass through a slit 50 in the bracket base 44. The threaded screw includes a cap whose diameter is larger than the slit. Upon rotation of the screw 16 by the use of an appropriate tool such as a spanner, the edge form bracket is then securely and tightly held to the casting bed 10 as is thus the edge form 18. The slit allows the edge form bracket to be moved forwards and rearwards so that it may be accurately positioned on the casting bed.

So as to be able to remove the bracket 12 from the casting bed, the slit 50 includes a keyhole aperture 52 whose diameter is greater than that of the screw cap. This then allows the bracket to be lifted away from the casting bed without having to completely unscrew the threaded screw.

Typically, the base 44 and the side 46 of the edge form bracket 12 are generally perpendicular to each other so that the edge forms are generally horizontal. This is a preferred arrangement for it assists in ensuring that the concrete panels themselves will be of a constant cross-sectional thickness. However, due to possible imperfections in the casting bed or the edge forms it may be necessary to adjust or tilt of the edge forms.

Figure 7:
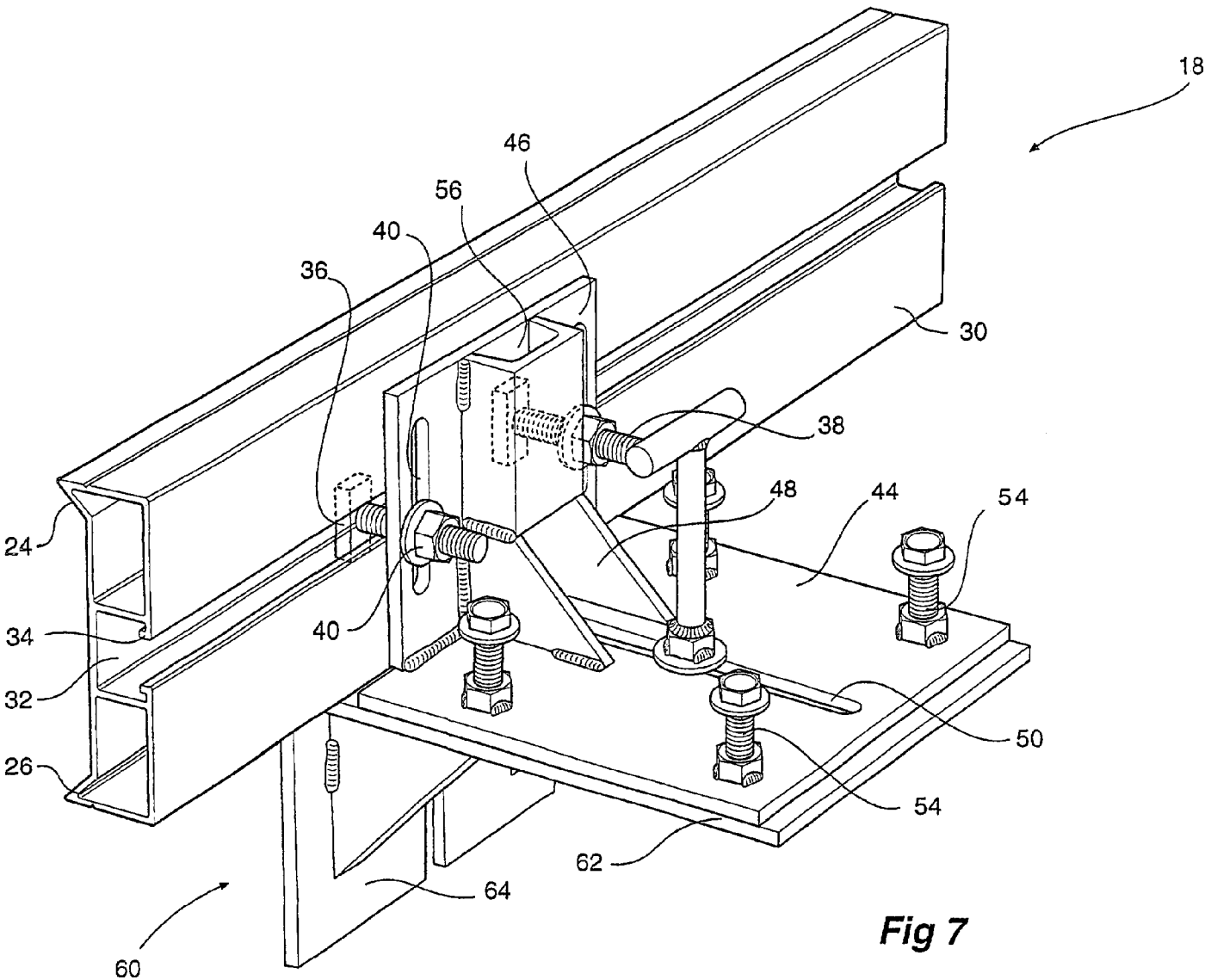
FIG. 7 is a perspective view of a second embodiment of an edge form and an anchor bracket according to the present invention.

As illustrated in FIG. 7, this may be achieved by the use of adjusting screws 54 on an alternate embodiment of the edge form bracket 12. Typically four screws adjacent each corner of the edge form bracket base are used. These screws abut the surface of the casting bed. As each of the screws 42 are rotated to engage the casting bed they cause the base 36 to be lifted away from the casting bed. If all the screws are unscrewed than obviously the base sits flush atop the casting bed. Rotating any one of the screws when it abuts the casting bed will then cause that corner of base at that point to be lifted from the bed. Since the edge form is fixedly attached to the edge form bracket this will cause a tilting of the edge form.

Typically any form-work arrangement edge form will have at least two edge form brackets if not more. The present system thus allows each of the edge forms to be tilted and lifted with respect to the casting bed.

The edge form bracket illustrated in FIG. 7 may further include a cavity 56 that may be used to hold and provide support for various attachments such as a cover plate (not shown). Such a cover plate may protect the edge form bracket from poured concrete that afterwards may be difficult to clean.

It will thus be readily apparent that use of edge forms secured to edge form brackets that are secured to the casting bed provides for form-work as illustrated in FIG. 1 that is ready to receive concrete for the manufacture of a first panel.

When the first concrete panel 58 has been poured and cured the form-work needs to be disassembled and reassembled to enable a further or second panel to be manufactured on top of the first.

The surface of the first concrete panel is coated with a suitable material that prevents bonding of the two panels so that the panels do not stick together.

In existing form-work arrangements, complex combinations of frames, sliding risers and buttresses are proposed whereby a frame is attached to the casting bed and used as a support for the edge forms as further panels are cast. In contrast, the present invention provides for each cured concrete panel to provide the support for the edge form-work required for the next concrete panel.

Figure 4:
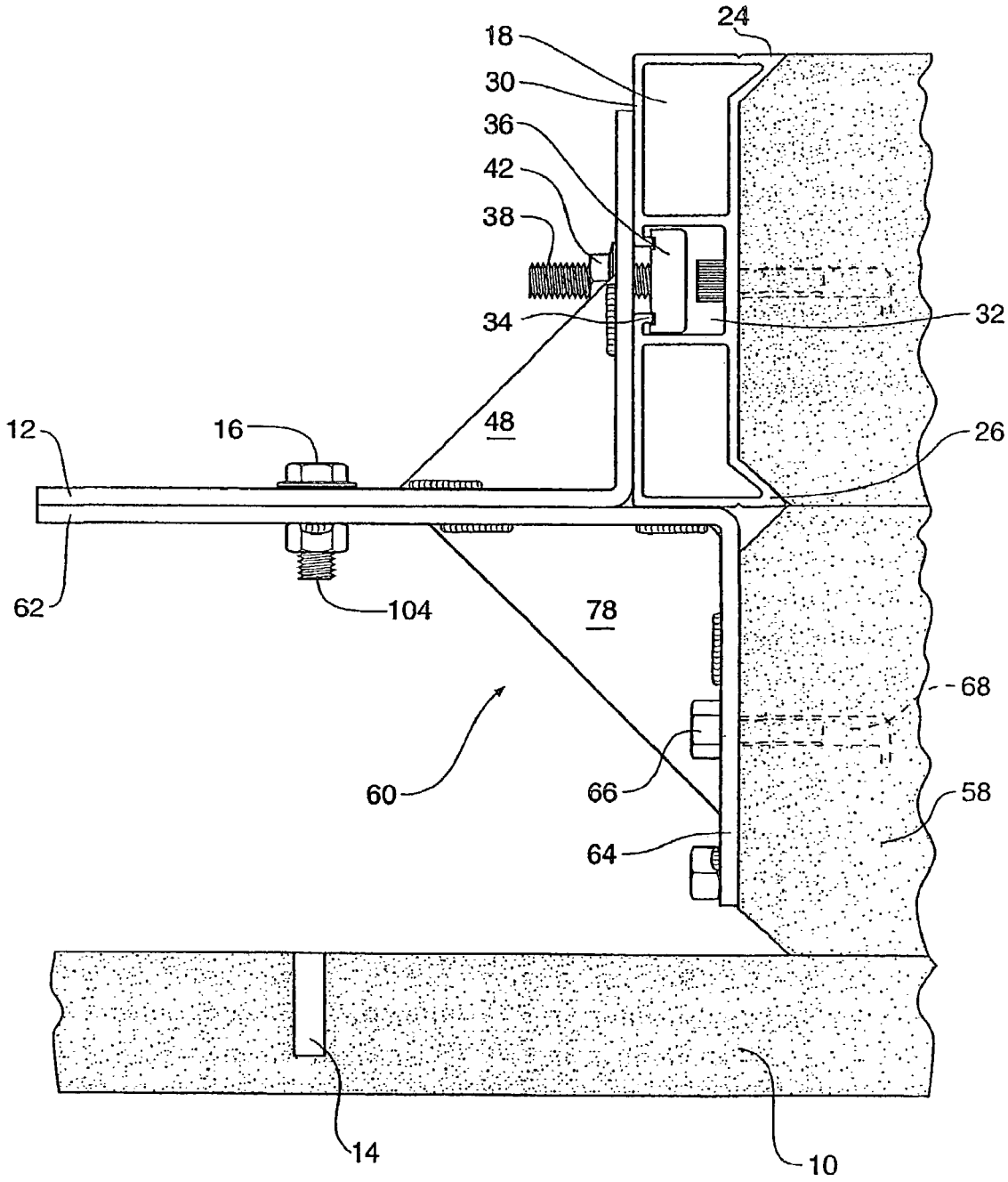
FIG. 4 is a cross-sectional view of the anchor bracket and edge form bracket according to the first embodiment of the invention when said anchor bracket is attached to a first previously poured panel and the form-work is arranged for the pouring of a second panel.
Figure 5:
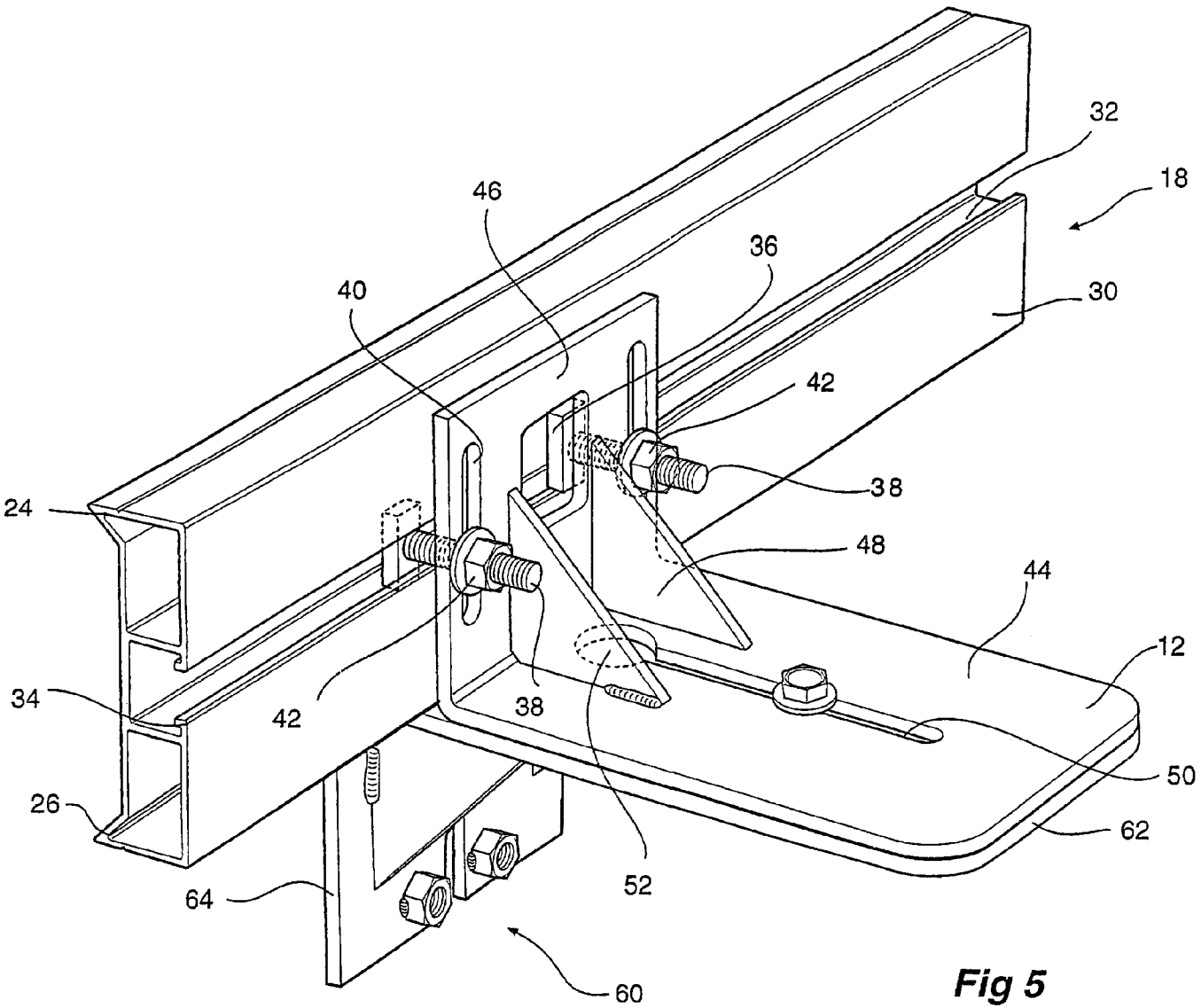
FIG. 5 is a perspective view of the edge form bracket supported by an anchor bracket, the anchor bracket supported by a previously poured panel.
Figure 6:
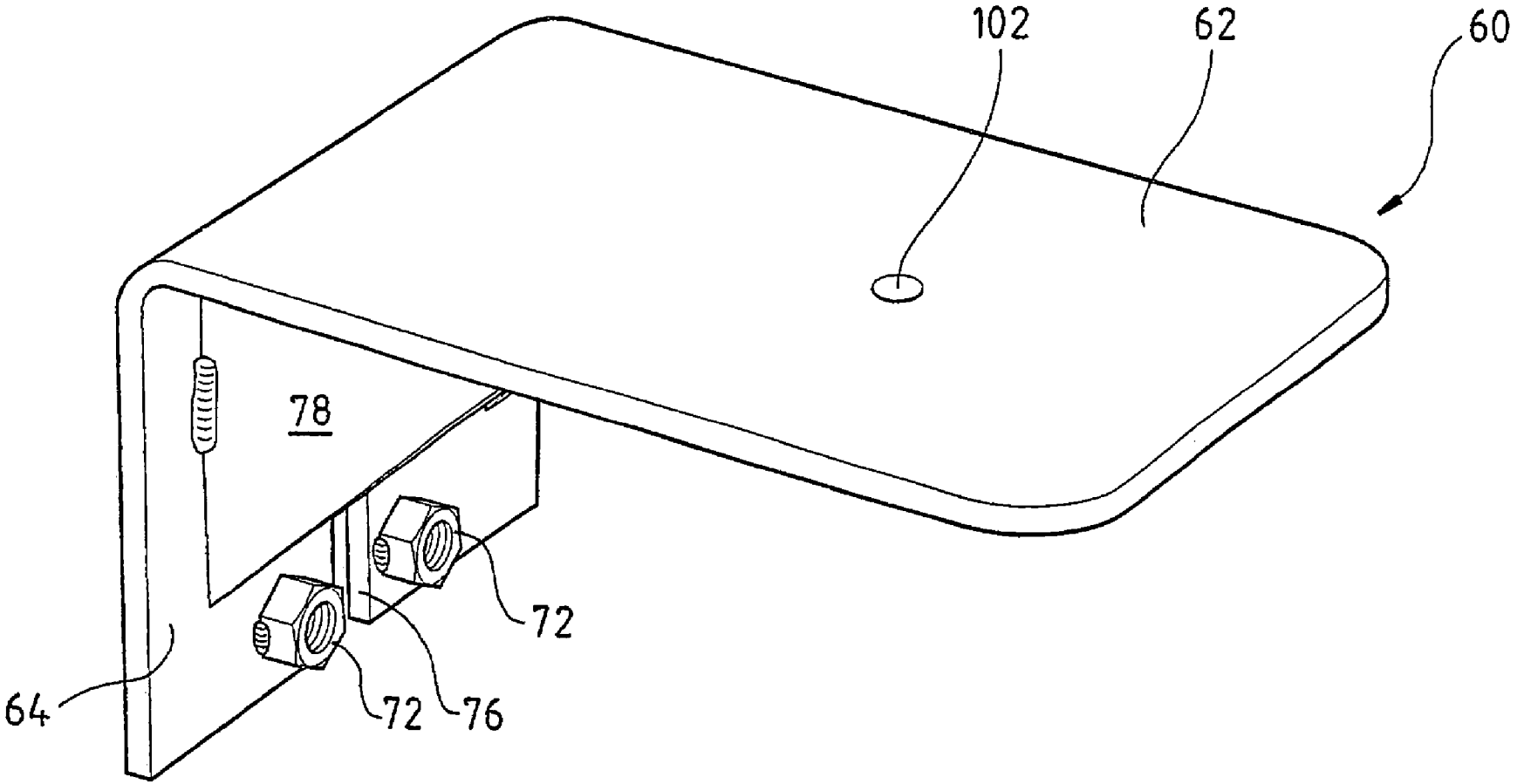
FIG. 6 is a perspective view of the anchor bracket of FIG. 4.

As illustrated in FIGS. 4–6 anchor bracket 60 attached to the concrete panel 58 provides the support for the edge form bracket 12. The anchor bracket 60 includes a base 62 and a side 64. The base 62 provides for the supporting surface on top of which is placed the edge form bracket 12. The side 64 of the anchor bracket is attached to the concrete panel 58.

One can thus readily appreciate that the support for the edge forms that define the space into which the second panel is to be poured is now provided by the previously poured concrete panel 58 removing the need for self-standing buttresses and the like.

The anchor bracket is attached to the side of the cured concrete panel by the use of a bolt 66 that engages ferrule 68 that has been previously moulded into the side of the panel. The ferrule 68 is held in place by the use of a screw that engages the ferrule and the edge form and thus keeps the ferrule in place until the concrete has set.

Figure 9:
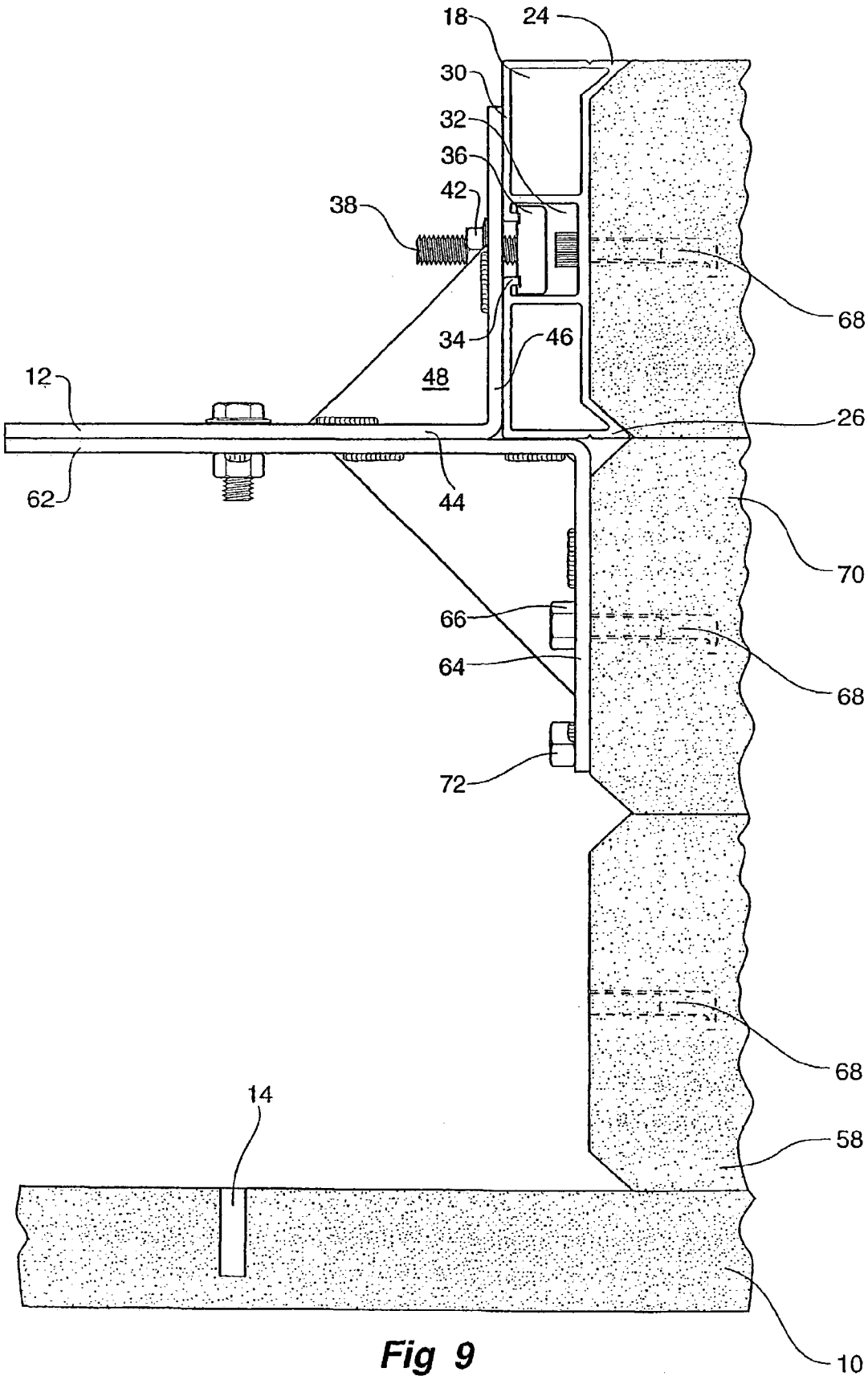
FIG. 9 is a cross-sectional view as in FIG. 4 but when the arrangement has been set for the formation of a third panel.

The above steps for preparing form-work are repeated and the next concrete panel poured until the desired number of panels is made. FIG. 9 illustrates the arrangement when the form-work has been prepared for the pouring of the third panel, the second panel 70 already having been poured and cured.

Figure 8:
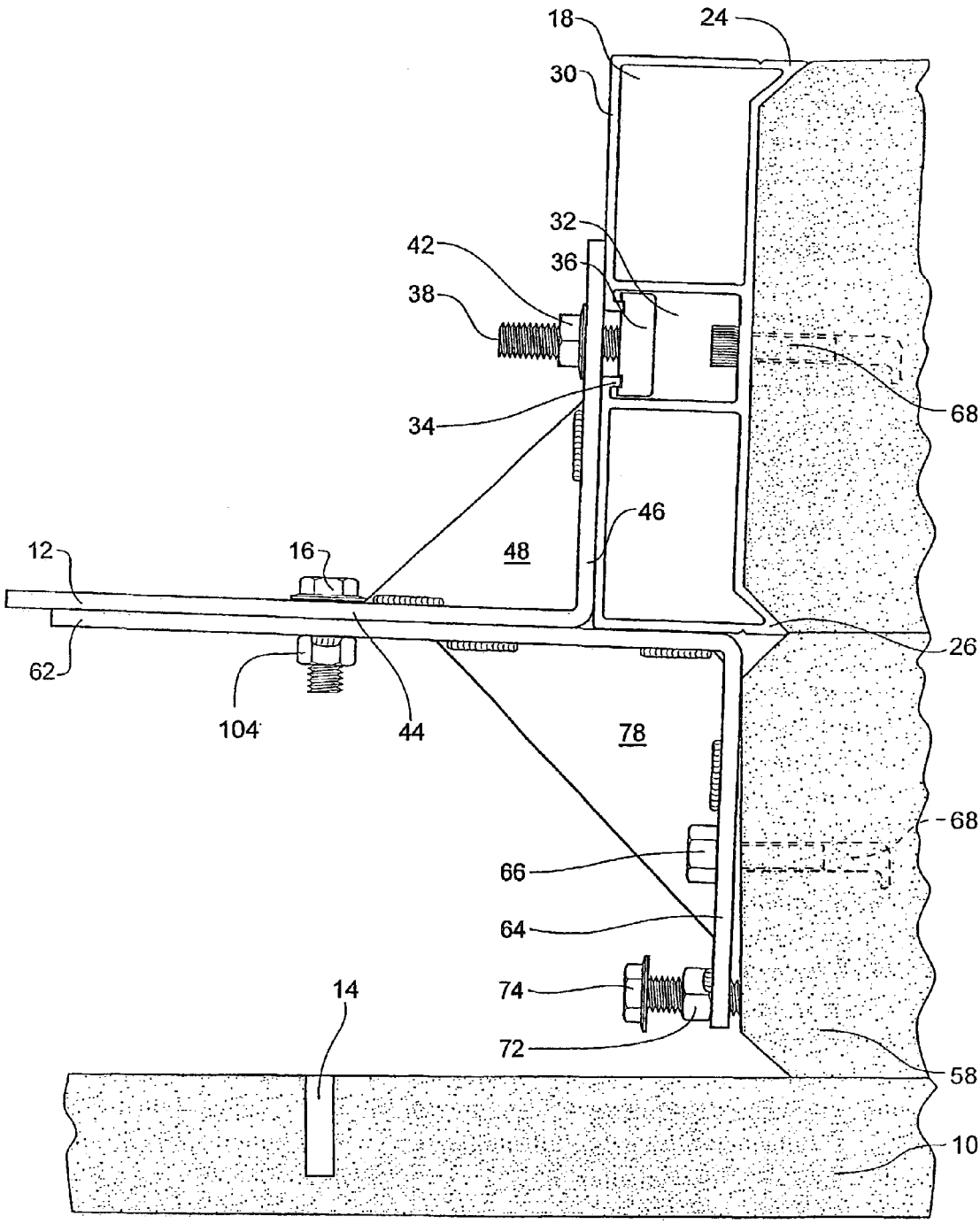
FIG. 8 is a cross-sectional view as in FIG. 4 but when the side form has been adjusted in its tilt by the use of the anchor bracket.

FIG. 8 illustrates how the anchor bracket can be tilted so as to adjust the tilt of the edge form bracket and thus the edge form. This may be used if the edge of the next panel to be poured has to be at an angle or where the side of the panel into which is attached the anchor bracket is not at the right angle. The side 64 of the anchor bracket 60 has at its lower end a pair or threaded nuts 72 that are fixed to the anchor side. A threaded bolt 74 passes through the nuts and the side of the anchor bracket abutting the side of the concrete panel. One can then appreciate that further rotation of the bolt causes the side to be forced away form the panel thus tilting the whole anchor bracket.

This embodiment is in contrast with that shown in FIG. 7, described above, where the adjustment of the tilt of the edge form bracket was accomplished through the use of adjustment screws in the base 44 of the edge form bracket.

As previously noted the anchor bracket 60 is attached to the side of the concrete panel 58 by use of bolt 66. To enable vertical adjustment of the anchor bracket, the side may include a slit 76 through which passes bolt 66 that attaches the anchor bracket to the side of the concrete panel. The width of the slit is sufficient to accommodate the main body of the bolt but is narrower than the head of the bolt. Brace members 78 provide extra support for the bracket.

Figure 11:
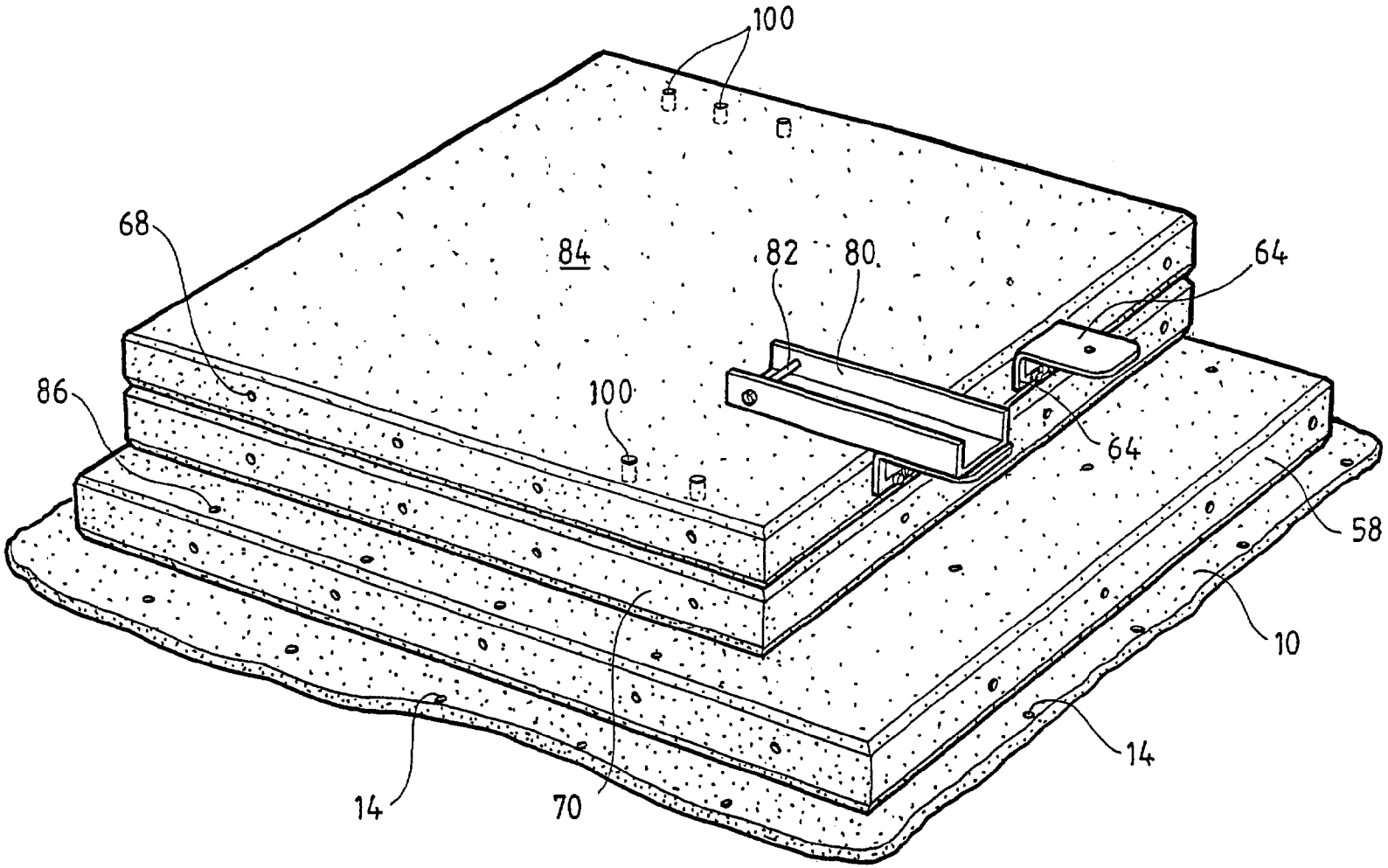
FIG. 11 is a perspective view illustrating the positioning of the anchor bracket on a poured concrete panel.

To accurately position the anchor bracket 60 on the side of the concrete panel 58, one can use a positioning member 80 which, as illustrated in FIG. 11, is a flat surfaced C-channel with handle 82 whose length is such that it extends both over part of the surface 84 of the concrete panel and over the anchor bracket 60. The C-channel, being substantially straight, enables the anchor to be positioned so that its base upper surface 62 is flush or level with the surface 84 of the concrete panel.

Generally one would then hold the anchor bracket in that position until it is tightly screwed to the concrete panel. An alternative would be to attach the anchor bracket to the positioning member 80 so that one does not need to separately support the anchor bracket. If the positioning member is chosen to be long enough it may even have sufficient mass that its centre of rotation is located above the concrete panel and does therefore not need to be supported. A simple way to attach the anchor bracket to the positioning member is by the use of magnets (not shown).

As illustrated in FIG. 11, if the concrete panel 70 needs to be of a size smaller than the previous one 58 anchor holes 86 are simply manufactured in the previously concrete panel that are roughly positioned at the location suitable. The anchor plate is then not required since the edge form bracket is placed and attached directly on top of the existing concrete panel. The slit 50 also enables for fine adjustment of the edge form bracket.

Figure 10:
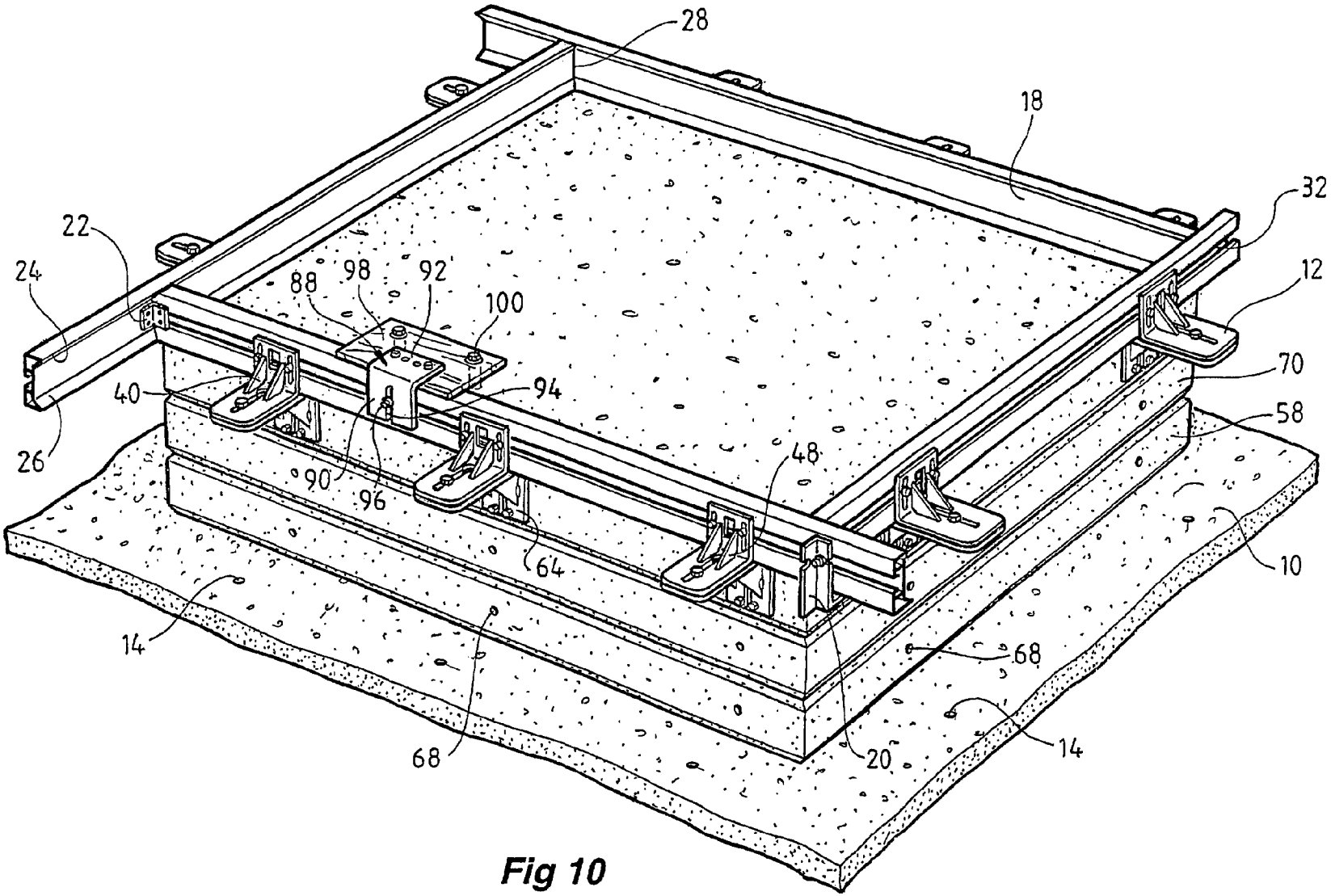
FIG. 10 is a perspective view of the arrangement when it has been prepared for the pouring of the fourth panel.

Once the concrete panels are cured and a stack has been completed it is then necessary to be able to lift the concrete panels individually. To provide an anchor point by which a lifting means may be attached to, one may need to manufacture ferrules in the surface of each panel. FIG. 10 illustrates this. A ferrule locator bracket 88 is generally L-shaped with one side 90 attachable to the edge form and the other 92 extending over the top of the form-work cavity. Side 90 includes a slit 94 through which passes bolt 96 adapted to engage the edge form with the same block type arrangement as previously discussed. To the top side 92 is screwed a flat member 98 (such as timber plywood) to which are attached ferrules 100. When the concrete is poured into the form-work it flows under the member 98 (it may have to be physically pushed as well). When the concrete has cured the member 98 is removed leaving behind the ferrules 100 firmly embedded into the concrete and that can then be used as a lifting anchor support.

Figure 12:
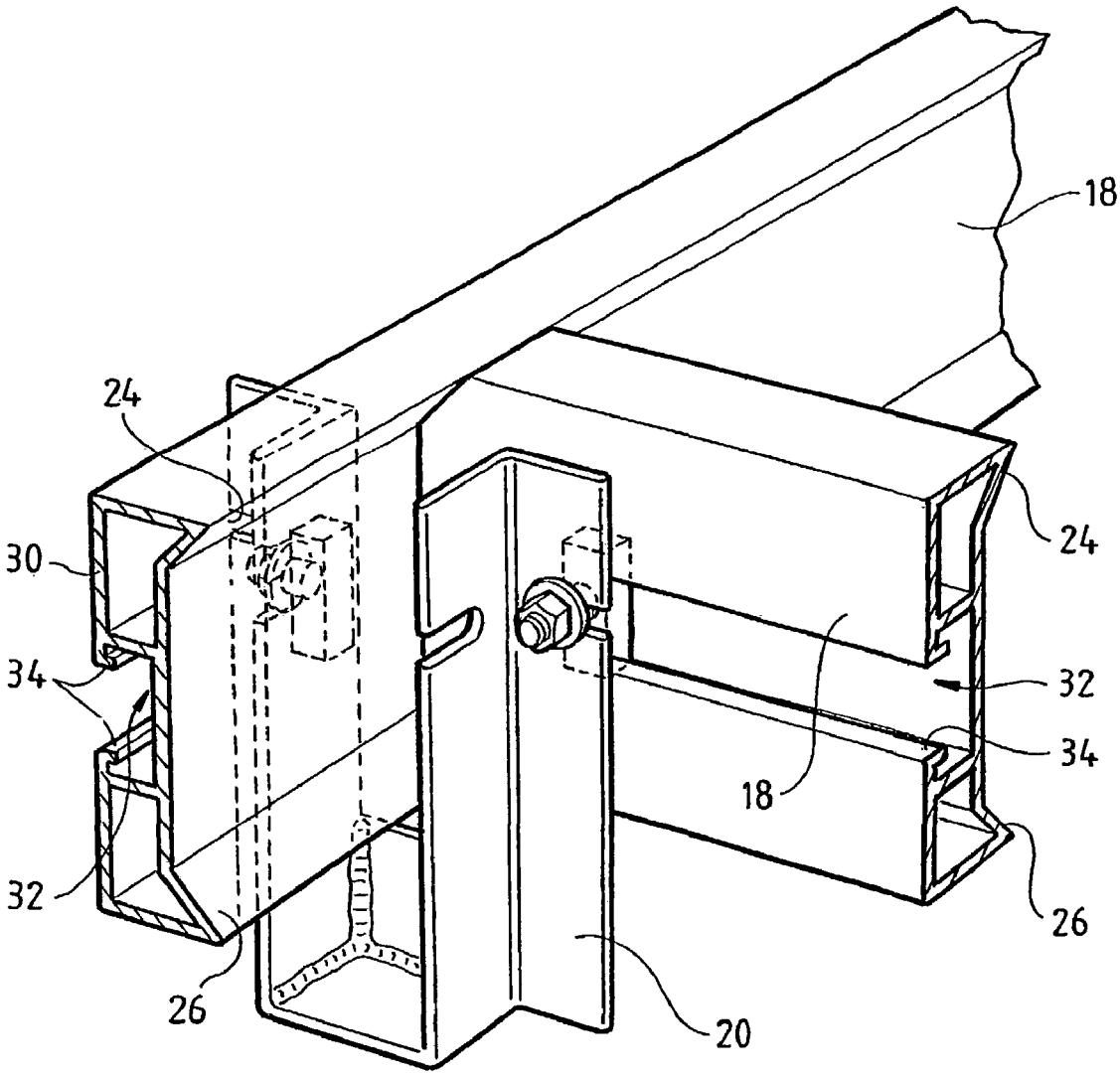
FIG. 12 is a perspective view illustrating an edge form corner connector.

Illustrated in FIG. 12 is the edge form corner connector 20 used in connecting the edge forms. The connector is generally a U-shaped bracket with each of the U-arms being of an L-shaped configuration having one side of the L-shape attachable to the edge form using the locking block arrangement previously described. It is also to be understood that edge form joiners that join two edge forms longitudinally may also be used, although not shown in this embodiment.

The edge form bracket is attached to the anchor bracket by using the threaded screw 16 passing through an aperture 102 in the anchor plate. A nut 104 is then used to secure the two brackets together. The anchor plate may very well have more than one aperture if required. Tool 106 may be used to act upon the nut 104 or in fact on any of the nuts in the arrangement since typically they will be of the one dimension.

The method of constructing concrete panels therefore includes firstly manufacturing the first concrete panel by the following steps:

preparing a casting bed, securing edge forms to edge form brackets that are secured to the casting bed to define a void and with ferrules extending into said void, pouring concrete into the void volume defined by the form-work and letting it cure to form a concrete panel, coating said upper surface of the cured concrete panel with a bond breaker.

The next panel is manufactured according to the steps of:

removing the edge form brackets supporting the edge forms from the casting bed, securing anchor brackets to the first concrete panel using the cast ferrules, attaching the edge form brackets supporting the edge forms to the anchor brackets to thereby define a second volume to be filled with concrete to define a second concrete panel.

The above process is repeated until the desired number of panels are made. It is also to be understood that there may very well be other steps involved in the manufacture, but these are the main ones.

Where a smaller panel is to be made, anchor points are drilled into the most recent panel at appropriate positions, which are then sued to fix in place the anchor brackets. In this way, much smaller panels may be made, and in fact if there is a large panel, several smaller panels may be made on the surface of the larger one.

When the panels are to be used, the anchor paints can simply be filled by the use of appropriate filling material.

It is also to be understood that an important feature of the invention is that the previously poured concrete panel provides the support for defining subsequent form-work.

Thus one can see that the present invention overcomes the problems of having to construct a frame work extending from the casting bed and that once cured a concrete panel is used to support subsequent form-work. This eliminates complex and large structures that have to be constructed, minimises the number of individual parts required and allows for greater flexibility in the size of the concrete panels to be made.

It will be appreciated that whilst concrete has been used to illustrate the present invention, the form-work may be used to mould many other curable no-solid materials. It will also be appreciated that the shape of the various brackets and forms is also not intended to be limited to the description of the preferred embodiment and many other shapes may very well fall within the scope of the invention.

It will be appreciated that the present disclosure is not intended to limit the invention to the preferred embodiment. The person skilled in the art will appreciate the various modifications, changes and substitutions which may be made without departing from the scope of the invention. The descriptions of the subject matter in this disclosure are illustrative of the invention and are not intended to be construed as limitations upon the scope of the invention.

The invention claimed is:

1. A form-work support apparatus for building form-work used for moulding a concrete construction panel on top of a previously poured concrete panel wherein the upper panel to be moulded has the same or smaller horizontal dimension as the previously poured panel, said apparatus comprising:

an anchor bracket having an anchor bracket side and an anchor bracket base, said anchor bracket being right-angled with said anchor bracket side and said anchor bracket base attached perpendicular to each other;

an edge form bracket having an edge form bracket side and an edge form bracket base attached perpendicular to each other, said edge form bracket being right-angled with said edge form bracket side and said edge form bracket base attached perpendicular to each other;

and an edge form having an outer face and an inner face on opposing sides of said edge form;

wherein said anchor bracket side is removably attachable to a concrete panel, said concrete panel having a first horizontal dimension ending at said anchor bracket side;

wherein said edge form bracket base is removably attached to said anchor bracket base in a plane of contact parallel to said edge form bracket base and said anchor bracket base;

wherein said edge form bracket base has an aperture allowing horizontally slidable positioning of said edge form bracket base over said anchor bracket base in said plane of contact;

wherein said edge form bracket side is removably attached to and removably supporting said edge form on said inner face; and wherein said edge form's outer face defines a second horizontal dimension, said second horizontal dimension being parallel and the same or smaller than said first horizontal dimension of said concrete panel.

2. A form-work support apparatus as in claim 1 wherein said edge form supports externally accessible ferrules within the form-work arrangement prior to the concrete being poured, the ferrules then being embedded within the concrete panel.

3. A form-work apparatus as in claim 2 wherein said anchor bracket side is attached to the concrete panel by the use of threaded bolts engaging said anchor bracket side and said ferrules.

4. A form-work apparatus as in claim 1 wherein said anchor bracket has a tilting means to adjust the vertical orientation of said anchor bracket.

5. A form-work apparatus as in claim 4 wherein the tilting means includes a threaded bolt engaging said anchor bracket wherein upon rotation of the bolt in one direction it is caused to abut against the side of the concrete panel and move the anchor bracket side away form said panel and upon rotation in the other direction it is caused to move the anchor bracket side in a direction towards said panel.

6. A form-work apparatus as in claim 1 wherein said edge form bracket base includes a slot extending substantially along its length, said slot adapted to accommodate a fixing means attaching said edge form bracket base to said anchor form bracket base.

7. The form-work support apparatus as in claim 1 further comprising:

a generally rectangular edge form having top and bottom fillets at the outer face of the edge form.

8. The form-work support apparatus as in claim 7 wherein the generally rectangular edge form has a rear channel having inwardly folded flanges.

9. The form-work support apparatus as in claim 8 wherein the edge form bracket side is attached to the edge form utilizing at least one locking block inserted into the rear channel.

* * * * *